US007750566B2

(12) United States Patent
Kim

(10) Patent No.: US 7,750,566 B2
(45) Date of Patent: Jul. 6, 2010

(54) PLASMA DISPLAY PANEL HAVING REFLECTIVE LAYER

(75) Inventor: Ji-Suk Kim, Suwon-si (KR)

(73) Assignee: Samsung SDI Co., Ltd., Maetan-dong, Yeongtong-gu, Suwon-si, Gyeonggi-do (KR)

( * ) Notice: Subject to any disclaimer, the term of this patent is extended or adjusted under 35 U.S.C. 154(b) by 298 days.

(21) Appl. No.: 11/905,377

(22) Filed: Sep. 28, 2007

(65) Prior Publication Data

US 2008/0174243 A1 Jul. 24, 2008

(30) Foreign Application Priority Data

Jan. 22, 2007 (KR) ..... 10-2007-0006704

(51) Int. Cl.
*H01J 1/62* (2006.01)

(52) U.S. Cl. ..... 313/582; 313/584

(58) Field of Classification Search ..... 313/582–584
See application file for complete search history.

(56) References Cited

U.S. PATENT DOCUMENTS 5,182,489 A * 1/1993 Sano ..... 313/485
5,541,618 A 7/1996 Shinoda
5,661,500 A 8/1997 Shinoda et al.
5,663,741 A 9/1997 Kanazawa
5,674,553 A 10/1997 Shinoda et al.
5,724,054 A 3/1998 Shinoda
5,786,794 A 7/1998 Kishi et al.
5,952,782 A 9/1999 Nanto et al.
RE37,444 E 11/2001 Kanazawa
6,498,431 B1 * 12/2002 Katayama et al. ..... 313/582
6,630,916 B1 10/2003 Shinoda
6,707,436 B2 3/2004 Setoguchi et al.

FOREIGN PATENT DOCUMENTS

JP 03246857 A * 11/1991

(Continued)

OTHER PUBLICATIONS

*Search report* from the European Patent Office issued in Applicant's corresponding European Patent Application No. 07119532.5 dated May 23, 2008.

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms and Discharge Characteristics; Annex C—Gaps and Annex D—Manufacturing.

*Primary Examiner*—Vip Patel
(74) *Attorney, Agent, or Firm*—Robert E. Bushnell, Esq.

(57) ABSTRACT

A plasma display panel is constructed with a first substrate on which images are displayed, a second substrate disposed facing and spaced apart from the first substrate by a certain distance, a plurality of barrier ribs disposed between the first substrate and the second substrate to define a plurality of discharge cells, a plurality of discharge electrodes extending along lines of the discharge cells, a plurality of phosphor layers formed on interior walls of the discharge cells, an optical reflective layer disposed between the phosphor layers and the second substrate, and a discharge gas filling the discharge cells. The optical reflective layer reflects the visible light that is radiated toward the second substrate, along the image display direction, i.e., towards the first substrate. In addition, the barrier ribs are made from a material having a high optical transmittance that does not absorb the visible light.

19 Claims, 4 Drawing Sheets

FOREIGN PATENT DOCUMENTS

| | | |
|---|---|---|
| JP | 2845183 | 10/1998 |
| JP | 02-148645 | 4/1999 |
| JP | 2001-043804 | 2/2001 |
| JP | 2001-325888 | 11/2001 |
| KR | 10-2004-0021177 | 3/2004 |

* cited by examiner

PLASMA DISPLAY PANEL HAVING REFLECTIVE LAYER

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 22 Jan. 2007 and there duly assigned Serial No. 10-2007-0006704.

BACKGROUND OF THE INVENTION

1. Field of the Invention

The present invention relates to a plasma display panel, and more particularly, to a plasma display panel having increased brightness and driving efficiency.

2. Description of the Related Art

Plasma display panels are flat display panels that display video images using light emitted due to a gas discharge. Since plasma display panels have excellent display characteristics, such as high brightness, high contrast, low latent image, thin size, and large viewing angle, plasma display panels are expected to become one of the next generation flat panel display devices.

A plasma display panel is typically constructed with a plurality of discharge cells between a first substrate and a second substrate facing each other. A plurality of discharge electrodes for generating discharge can be disposed parallel to each other and across the discharge cells. In the plasma display panel, a certain video image that can be viewed by viewers is displayed through a series of light emitting processes. Hence, when a gas discharge is generated by applying a certain alternating current between the discharge electrodes, ultraviolet rays are generated from a discharge gas that fills the discharge cells. The ultraviolet rays then excite phosphor materials included in phosphor layers coated on walls of the discharge cells in order to generate visible light. The visible light is emitted to the outside through the first substrate, and thus, viewers can recognize a certain image.

Visible light emitted from the phosphor layers is emitted in a wide range of angles without a particular direction. Therefore, the visible light emitted through the first substrate, which is a display surface, displays a certain image. Visible light emitted through the second substrate opposite to the first substrate, however, may be wasted since the visible light does not contribute to the displayed image. Also, a significant amount of power is consumed to generate the wasted visible light emitted towards the second substrate, thereby reducing the driving efficiency of the plasma display panel.

SUMMARY OF THE INVENTION

It is therefore an object of the present invention to provide an improved plasma display panel.

It is another object to provide a plasma display panel able to achieve high brightness and high driving efficiency by minimizing waste of visible light generated from plasma discharge within the panel.

According to an aspect of the present invention, a plasma display panel may be constructed with a first substrate on which images are displayed, a second substrate disposed facing and spaced apart from the first substrate by a certain distance, a plurality of barrier ribs disposed between the first substrate and the second substrate to define a plurality of discharge cells, a plurality of discharge electrodes extending along lines of the discharge cells, a plurality of phosphor layers formed on interior walls of the discharge cells, an optical reflective layer disposed between the phosphor layers and the second substrate, and a discharge gas filling the discharge cells.

The barrier ribs may be made from a high optical transmittance polymer material. For example, the barrier ribs may be made from at least one polymer material selected from the group consisting of polyethylene terephthalate (PET), acryl, and silicon so that the visible light generated from the phosphor layers is transmitted.

The optical reflective layer may be made from a highly reflective material layer, for example, a metal thin film layer. The optical reflective layer may be formed on an inner surface of the second substrate that is facing the first substrate.

A plurality of address electrodes may be disposed on the optical reflective layer extending to cross the discharge electrodes. When the optical reflective layer is a metal thin film layer, an insulating layer may be interposed between the optical reflective layer and the address electrodes.

The optical reflective layer may be made from an optical reflective film laminated on the second substrate. The optical reflective film may have a multi-layered structure in which transparent material layers having different refractive indices from each other are alternately stacked.

According to another aspect of the present invention, a plasma display panel may be constructed with a first substrate on which images are displayed, a second substrate disposed facing and spaced apart from the first substrate by a certain distance, a plurality of barrier ribs disposed between the first substrate and the second substrate to define a plurality of discharge cells, a plurality of discharge electrodes extending along lines of the discharge cells, a plurality of phosphor layers formed on interior walls of the discharge cells, an optical reflective layer disposed on a lower surface of the second substrate that is opposite to the surface facing the first substrate, and a discharge gas filling the discharge cells.

The barrier ribs may be made from a high optical transmittance polymer material, for example, at least one polymer material selected from the group of PET, acryl, and silicon so that the visible light generated from the phosphor layers is transmitted.

The optical reflective layer may be made from a highly reflective material layer, for example, a metal thin film layer formed on the second substrate.

The optical reflective layer may be made from an optical reflective film laminated on the second substrate. The optical reflective film may have a multi-layered structure in which transparent material layers having different refractive indices from each other are alternately stacked.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
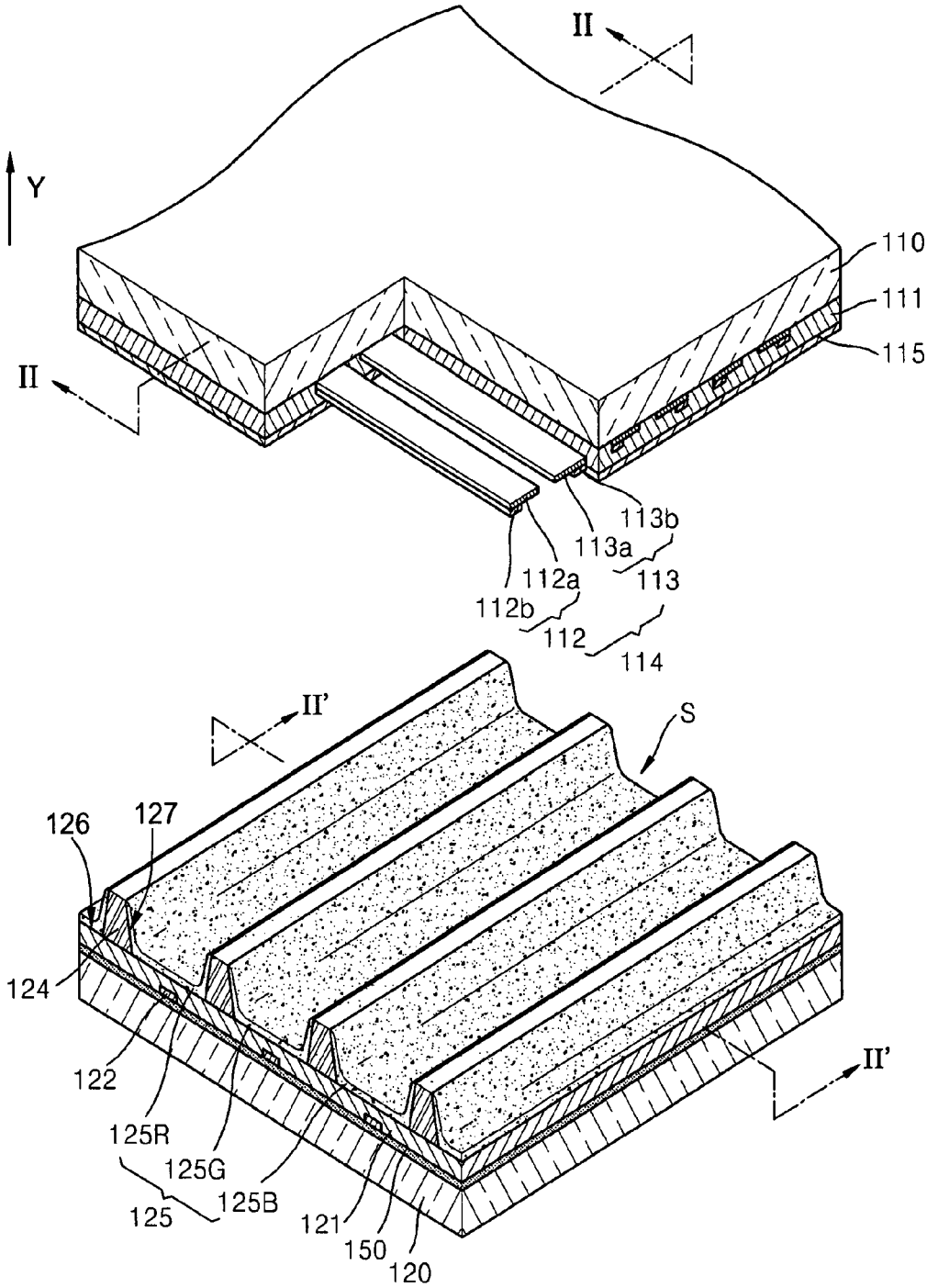
FIG. 1 is an exploded oblique view illustrating a plasma display panel constructed as a first embodiment according to the principles of the present invention.

The present invention will now be described more fully with reference to the accompanying drawings in which exemplary embodiments of the invention are shown. In the drawings, the thicknesses of layers and regions are exaggerated for clarity, and like reference numerals refer to like elements.

Figure 2:
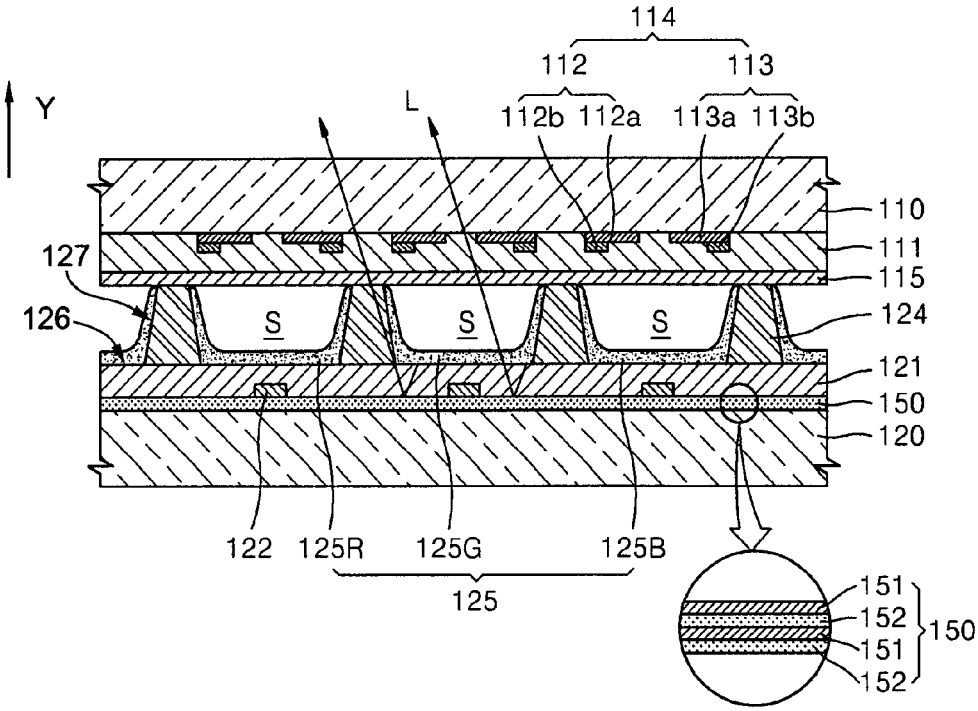
FIG. 2 is an oblique cross-sectional view taken along mutually orthogonal cross-sectional lines II-II and II'-II' of FIG. 1, according to the first embodiment of the principles of the present invention.

FIG. 1 is an exploded oblique view illustrating a plasma display panel constructed as a first embodiment according to the principles of the present invention, and FIG. 2 is a cross-sectional view taken along mutually orthogonal cross-sectional lines II-II and II'-II' of FIG. 1, according to the first embodiment of the present invention. Referring to FIGS. 1 and 2, the plasma display panel is constructed with a first substrate 110 and a second substrate 120 facing and spaced apart from each other by a certain distance. First substrate 110 can be either a glass substrate made from a highly transparent glass material in consideration of a transmittance of visible light in an upper direction Y, or a plastic substrate made from an optically transparent plastic material having flexibility so as to realize a flexible display. Second substrate 120 can be either a glass substrate or a plastic substrate made from a flexible material like first substrate 110.

A plurality of discharge electrode pairs 114 are formed parallel to each other on first substrate 110 to induce a gas discharge. Each of discharge electrode pairs 114 includes a first discharge electrode 112 and a second discharge electrode 113. First discharge electrode 112 is constructed with a transparent electrode 112*a* and a bus electrode 112*b* formed on transparent electrode 112*a*. Second discharge electrode 113 is constructed with a transparent electrode 113*a* and a bus electrode 113*b* formed on transparent electrode 113*a*. Transparent electrodes 112*a* and 113*a* are made from a material that is transparent to light across the visible spectrum and electrically conduction such as indium tin oxide (ITO). Bus electrodes 112*b* and 113*b* may be made from metal with a lower resistance than that of ITO, such as Ag, Al, or a multiple layer structure using Cr/Al/Cr or Cr/Cu/Cr. The present invention, however, does not limit the materials for the low-resistance bus electrode. Bus electrodes 112*b* and 113*b* are respectively formed on transparent electrodes 112*a* and 113*a* to increase the overall electrical conductivity of discharge electrodes 112 and 113. First and second discharge electrodes 112 and 113 of discharge electrode pairs 114 can be buried in a dielectric layer 111 coated on first substrate 110. Dielectric layer 111 prevents first and second discharge electrodes 112 and 113 of discharge electrode pairs 114 from being damaged by charged particles generated due to the gas discharge, and provides an advantageous environment for generating discharge by inducing the emission of secondary electrons during the discharge. Also, dielectric layer 111 can be protected by protective layer 115 that is usually made from MgO.

Plurality of address electrodes 122 are formed parallel to each other on second substrate 120 in a perpendicular direction with respect to first and second discharge electrodes 112 and 113 of discharge electrode pairs 114. Address electrodes 122 enable a selection of discharge cells S to be lit by generating an address discharge together with either one of first discharge electrodes 112 or second discharge electrodes 113. Dielectric layer 121 that buries address electrodes 122 is formed on second substrate 120.

A plurality of barrier ribs 124 are formed between first substrate 110 and second substrate 120 in order to define discrete spaces between first substrate 110 and second substrate 120 into the plurality of discharge cells S. Barrier ribs 124 extend in a stripe pattern to define discharge cells S in an open type structure. The structure of barrier ribs 124, however, is not limited to stripe patterns according to the present invention. That is, barrier ribs 124 can be formed in a matrix pattern to define discharge cells S in a closed rectangular shape, or can be formed in various patterns to define discharge cells S in various closed structures such as a polygon, a circle, or an oval.

Barrier ribs 124 may be made from an optically transparent material having a transmittance of more than 80% for visible light. The optically transparent material of barrier ribs 124 can be polyethylene terephthalate (PET), acryl, silicon, or a transparent polymer material. Barrier ribs 124 can be formed such that, after coating an optically transparent paste for forming barrier ribs 124 on the entire surface of second substrate 120, the optically transparent paste is patterned to a desired shape of barrier ribs 124 using a lithography method. As described above, visible light that is used for displaying an image is emitted through a series of light emission processes from a display discharge. Contemporary barrier ribs which are formed to have a certain color, however, absorb the generated visible light and thereby reduce brightness of the plasma display panel. Due to the absorbed visible light, power consumption of the plasma display panel must be increased. Therefore, in the present embodiment, barrier ribs 124 having a high optical transmittance for visible light are formed to transmit most of the generated visible light and thereby increase both brightness and driving efficiency of the plasma display panel.

Optical reflective layer 150 is formed between barrier ribs 124 and second substrate 120. Therefore, visible light L that is radiated towards second substrate 120, is reflected by optical reflective layer 150 along display direction Y in order to prevent visible light L from being wasted during an emission of visible light L and thereby increases brightness and driving efficiency of the plasma display panel. At this point, optically transparent barrier ribs 124 can minimize an optical loss due to the absorption of light in the process of transmitting visible light L towards optical reflective layer 150 or in the process of the re-emitting visible light L by optical reflective layer 150 along display direction Y.

Optical reflective layer 150 can be constructed with a first transparent material layer 151 having a first refractive index and a second transparent material layer 152 having a second refractive index that is different from the first refractive index of first transparent material layer 151, so that optical reflective layer 150 can have a reflectivity of at least 90% or higher. The reflectivity is defined as the fraction of visible light L that is reflected by optical reflective layer 150. First transparent material layer 151 and second transparent material layer 152 are alternately stacked. Each first transparent material layer 151 and second transparent material layer 152 has a thickness of $\lambda 4$ in terms of wavelength $\lambda$ of visible light L. The red, green, and blue light rays, with the wavelength of each monochromatic lights ray having a different range, are generated inside the cells as results of the discharge. The generated lights are directed toward outside by the reflection of optical reflective layer 150. There is no predetermined specific value of wavelength λ, and while it is not necessary to limit the wavelength λ to a specific value, rather it is preferable that the range of λ is within the range between approximately 350 nm and approximately 750 nm. Optical reflective layer 150 can be formed by directly coating first and second transparent material layers 151 and 152 on second substrate 120 or by laminating an optical reflective film that includes first and second transparent material layers 151 and 152 on second substrate 120.

Phosphor layers 125 are formed on interior walls of discharge cells S. More specifically, phosphor layers 125 are formed on upper surface 126 of dielectric layer 121 that constitutes discharge cells S and side walls 127 of barrier ribs 124 defining the space of discharge cells S. Phosphor layers 125 transform ultraviolet rays, which are formed due to the gas discharge between first and second discharge electrodes 112 and 113, into visible light L. Hence, phosphor particles of phosphor layers 125 are excited by absorbing the ultraviolet rays, and emit monochromatic light of a particular wavelength while the phosphor particles of phosphor layers 125 return to a base energy state. At this point, the visible light generated from phosphor layers 125 is radiated in random directions. In the present embodiment, however, optical reflective layer 150 is formed on second substrate 120 so that the radiation direction of the visible light is concentrated towards first substrate 110 which is display direction Y. Phosphor layers 125 consist of red, green, and blue phosphor layers 125R, 125G, and 125B. Each of discharge cells S becomes a sub-pixel having either one of red, green, or blue color according to the colors of phosphor layers 125 coated on the corresponding discharge cells. Although it is not shown, a discharge gas that can be excited by a display discharge that fills discharge cells S.

Figure 3:
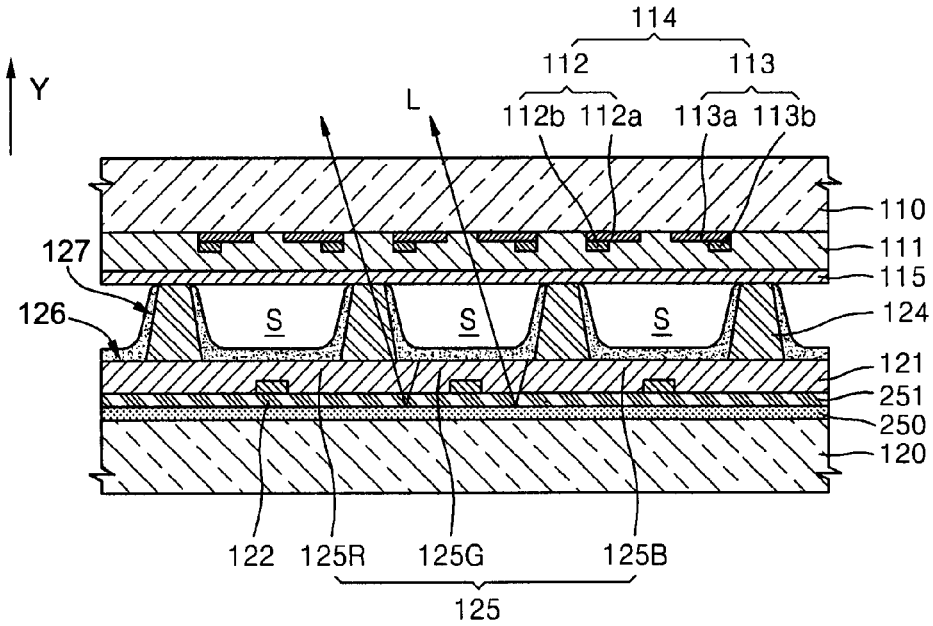
FIG. 3 is an oblique vertical cross-sectional view illustrating a plasma display panel constructed as a second embodiment according to the principles of the present invention.

FIG. 3 is a vertical cross-sectional view illustrating a plasma display panel constructed as a second embodiment according to the principles of the present invention. Referring to FIG. 3, a first substrate 110 and a second substrate 120 are spaced apart from each other by a certain distance, and a plurality of discharge cells S defined by barrier ribs 124 are disposed between first substrate 110 and second substrate 120. A plurality of discharge electrode pairs 114 are formed on first substrate 110, and a plurality of address electrodes 122 corresponding to discharge cells S are formed on second substrate 120. Phosphor layers 125 are coated on interior walls of discharge cells S, and a discharge gas (not shown) that can be excited by a discharge that fills discharge cells S.

An optical reflective layer 250 is formed between barrier ribs 124 and second substrate 120. Therefore, visible light L that is radiated from phosphor layers 125 towards second substrate 120, is reflected by optical reflective layer 250 towards first substrate 110, which is display direction Y, and thus, the radiation direction of the visible light generated from phosphor layers 125 is concentrated towards first substrate 110. Optical reflective layer 250 can be formed by coating a highly reflective material layer on second substrate 120, so that optical reflective layer 250 can have a reflectivity of at least 90%. For example, after a thin film made from a highly reflective aluminium having a certain thickness is formed on second substrate 120, optical reflective layer 250 can be obtained by mirror processing the thin film.

An insulating layer 251 can be formed on optical reflective layer 250. Thus, insulating layer 251 is interposed between optical reflective layer 250 and address electrodes 122 in order to prevent address electrodes 122, through which driving signals different from each other are transferred, from being shorted from each other due to the electrical conductive optical reflective layer 250. That is, insulating layer 251 is formed to prevent optical reflective layer 250 that is made from an electrical conductive and highly reflective metal thin film, from being directly connected with address electrodes 122. Therefore, insulating layer 251 can be omitted according to structure modifications if optical reflective layer 250 is made from a non-electrically conductive material or address electrodes 122 are spaced apart from optical reflective layer 250 by a certain distance.

Barrier ribs 124 can be made from an optical transparent material, for example, polyethylene terephthalate (PET), acryl, or silicon, so that barrier ribs 124 can have a transmittance of 80% or higher. Therefore, transparent barrier ribs 124 transmit most of the visible light in a process of transmitting visible light L that is radiated towards optical reflective layer 250 or in a process of re-emitting visible light L towards first substrate 110 after visible light L is reflected by optical reflective layer 250, and thereby minimize optical loss due to the light absorption by barrier ribs 124.

Figure 4:
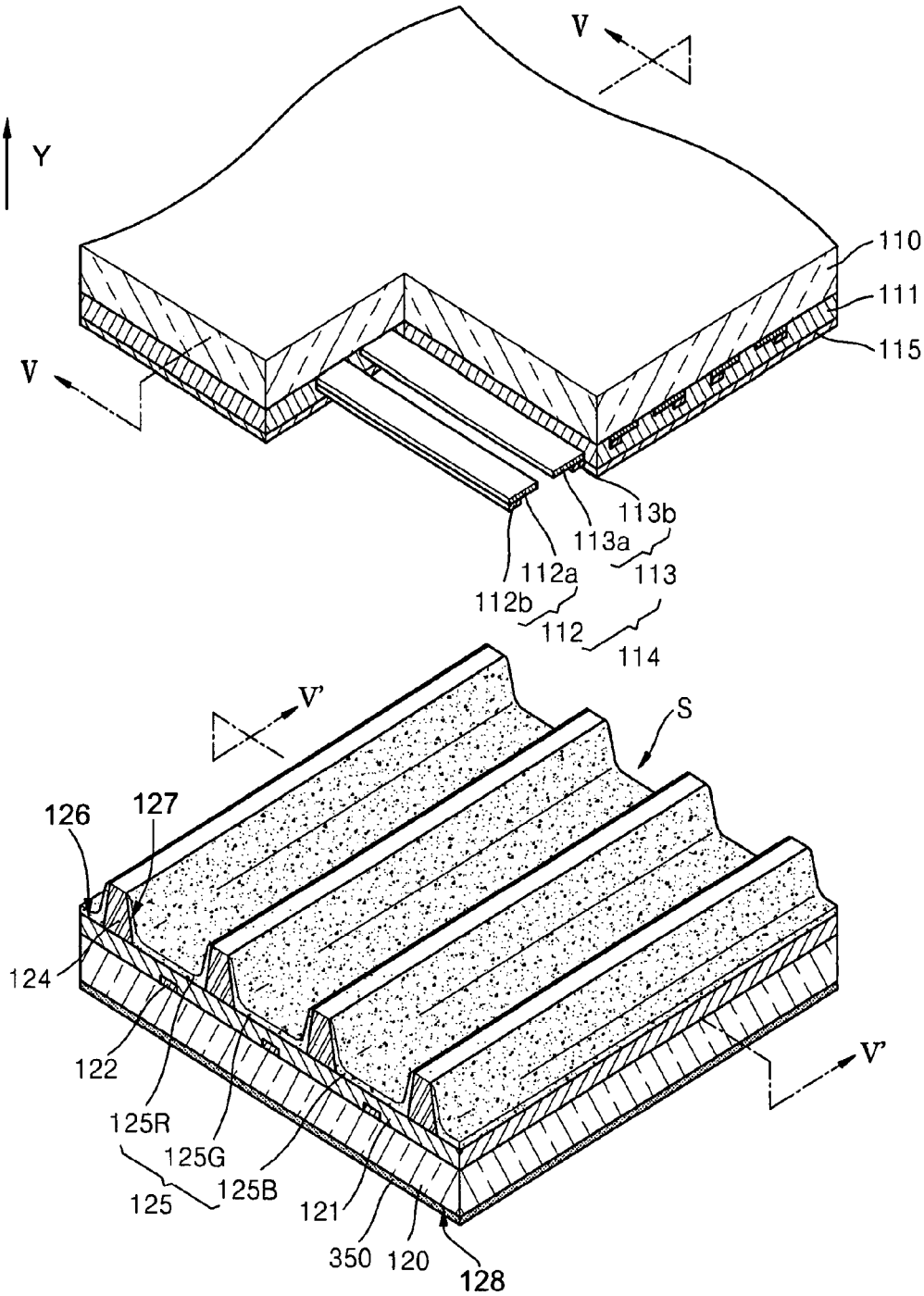
FIG. 4 is an exploded oblique view illustrating a plasma display panel constructed as a third embodiment according to the principles of the present invention.
Figure 5:
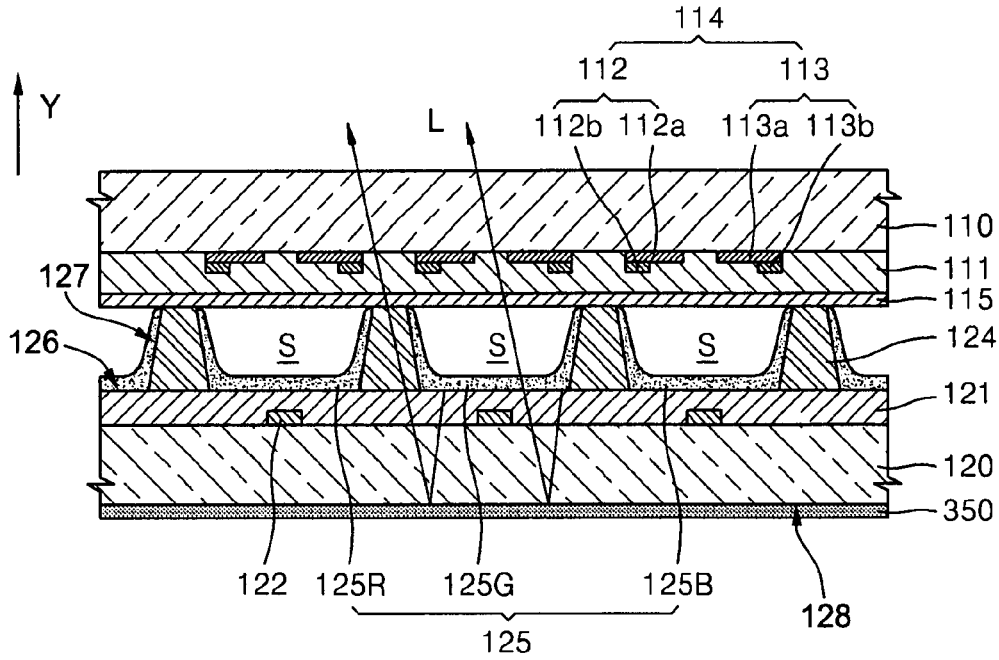
FIG. 5 is a vertical cross-sectional view taken along mutually orthogonal cross-sectional lines V-V and V'-V' of FIG. 4, according to the third embodiment of the principles of the present invention.

FIG. 4 is an exploded oblique view illustrating a plasma display panel constructed as a third embodiment according to the principles of the present invention, and FIG. 5 is a vertical cross-sectional view taken along mutually orthogonal cross-sectional lines V-V and V'-V' of FIG. 4, according to the third embodiment of the present invention. Referring to FIGS. 4 and 5, the plasma display panel according to the present embodiment is constructed with a first substrate 110 and a second substrate 120 facing and spaced apart from each other by a certain distance. A plurality of barrier ribs 124 between first substrate 110 and second substrate 120 define a space between first substrate 110 and second substrate 120 into a plurality of discharge cells S. Barrier ribs 124 may be made from a transparent material, for example, PET, acryl, or silicon, so that barrier ribs 124 can have a reflectivity of 80% or higher. Barrier ribs 124 having a desired shape can be obtained by applying a paste with a high optical transmittance on the entire surface of second substrate 120 and by patterning the paste through well-known patterning process. A plurality of first and second discharge electrodes 112 and 113 that form discharge electrode pairs 114 to perform discharge can be formed parallel to each other across discharge cells S arranged in lines. For example, first and second discharge electrodes 112 and 113 can be disposed on first substrate 110, and a plurality of address electrodes 122 can be formed on second substrate 120 in a direction perpendicularly to first and second discharge electrodes 112 and 113. First and second discharge electrodes 112 and 113 and address electrodes 122 respectively may be buried in dielectric layers 111 and 121 respectively formed on first substrate 110 and second substrate 120.

Phosphor layers 125 are formed on interior walls of discharge cells S. More specifically, phosphor layers 125 can be formed on side walls 127 of barrier ribs 124 that define discharge cells S and on upper surface 126 of dielectric layer 121. A discharge gas (not shown) that can be excited due to the discharge, fills discharge cells S. The discharge gas that is excited due to the discharge generates ultraviolet rays, that are subsequently transformed into visible light due to phosphor layers 125, and the visible light is emitted to the outside by passing through first substrate 110 and thereby displays a certain video image.

As an important configuration of the present embodiment, an optical reflective layer 350 is formed on a lower surface 128 of second substrate 120. As such, optical reflective layer 350 functions to reflect visible light, which is radiated towards second substrate 120 and could have been wasted if the visible light passes through second substrate 120, upwards towards first substrate 110, that is, the image display direction Y. In this way, the loss of the visible light can be prevented, and thus, brightness of images can be increased. Also, power consumption for realizing a certain brightness can be reduced by saving power required for generating visible light that could have been wasted. Optical reflective layer 350 according to the present embodiment differs from the structures of the plasma display panels depicted in FIGS. 2 and 3 in that optical reflective layer 350 is formed on lower surface 128 of second substrate 120. As shown in FIG. 5, since elements such as address electrodes 122 or dielectric layer 121 that are involved in the discharge are not disposed on lower surface 128 of second substrate 120, the limitations in terms of selecting a material for forming optical reflective layer 350 and a shape such as the planarity of lower surface 128 of second substrate 120 can be avoided. For example, optical reflective layer 350 can be readily made from an electrical conductive material such as an aluminium thin film using a simple process.

Therefore, optical reflective layers according to the principles of the present invention have been described. The scope of the present invention, however, is not limited by the exemplary materials or structures described above. That is, the material for forming the optical reflective layers may be any highly reflective material having a reflectivity of 90% or higher with respect to visible light.

In the present invention, an optical reflective layer is formed on a substrate opposite to the direction in which visible light is emitted so that all visible light generated from phosphor layers due to a discharge can be emitted along image display direction Y. The optical reflective layer reflects visible light, which could have been wasted to the outside, along the image display direction and thereby increases brightness of the images. Also, power consumption for realizing a certain brightness can be reduced by saving power used for generating visible light that could have been wasted and thereby increase driving efficiency of the plasma display panel.

In particular, when high optical transmittance barrier ribs are formed together with the optical reflective layer, optical loss due to the absorption of light by the barrier ribs in an transmitting path towards the optical reflective layer or in an emitting path of the reflected visible light from the optical reflective layer can be minimized and thereby further increase brightness and driving efficiency of the plasma display panel.

While the present invention has been particularly shown and described with reference to exemplary embodiments thereof, it will be understood by one of ordinary skill in the art that various changes in form and details may be made therein without departing from the spirit and scope of the present invention as defined by the following claims.

What is claimed is:

1. A plasma display panel, comprising:

a first substrate on which images are displayed;

a second substrate disposed facing and spaced apart from the first substrate by a certain distance;

a plurality of barrier ribs disposed between the first substrate and the second substrate to define a plurality of discharge cells;

a plurality of discharge electrodes extending along lines of the discharge cells;

a plurality of phosphor layers formed on interior walls of the discharge cells;

an optical reflective layer disposed between the phosphor layers and the second substrate; and a discharge gas filling the discharge cells, with the barrier ribs being made from an optically transmissive polymer material passing the visible light generated from the phosphor layers through the barrier ribs.

2. The plasma display panel of claim 1, with the barrier ribs being made from at least one polymer material selected from a group of PET (polyethylene terephthalate), acryl, and silicon.

3. The plasma display panel of claim 1, with the barrier ribs being made from an optically transmitting polymer material having a transmittance of more than 80% for light within the visible spectrum.

4. The plasma display panel of claim 1, with the optical reflective layer being made from an optical reflective material layer.

5. The plasma display panel of claim 4, with the optical reflective material layer being a metal thin film layer.

6. The plasma display panel of claim 1, with the optical reflective layer being formed on an inner surface of the second substrate, with the inner surface of the second substrate being facing the first substrate.

7. The plasma display panel of claim 1, further comprising a plurality of address electrodes disposed on the optical reflective layer extending to cross the discharge electrodes.

8. The plasma display panel of claim 7, with the optical reflective layer being made from a metal thin film layer, and an insulating layer being interposed between the optical reflective layer and the address electrodes.

9. The plasma display panel of claim 1, with the optical reflective layer being made from an optical reflective film laminated on the second substrate.

10. The plasma display panel of claim 9, with the optical reflective film having a multi-layered structure in which transparent material layers having different refractive indices from each other are alternately stacked.

11. The plasma display panel of claim 1, with the optical reflective layer having a reflectivity of at least 90% for visible light.

12. A plasma display panel, comprising:

a first substrate on which images are displayed;

a second substrate disposed facing and spaced apart from the first substrate by a certain distance;

a plurality of barrier ribs disposed between the first substrate and the second substrate to define a plurality of discharge cells;

a plurality of discharge electrodes extending along lines of the discharge cells;

a plurality of phosphor layers formed on interior walls of the discharge cells;

an optical reflective layer disposed on a lower surface of the second substrate, with the lower surface being opposite to the surface of the second substrate that is facing the first substrate; and a discharge gas filling the discharge cells, with the barrier ribs being made from an optically transmissive polymer material passing visible light generated from the phosphor.

13. The plasma display panel of claim 12, with the barrier ribs being made from an optically transmitting polymer material having a transmittance of more than 80% for light within the visible spectrum.

14. The plasma display panel of claim 12, with the barrier ribs being made from at least one polymer material selected from the group of PET, acryl, and silicon.

15. The plasma display panel of claim 12, with the optical reflective layer being made from an optical reflective material layer formed on the second substrate.

16. The plasma display panel of claim 15, with the highly reflective material layer being a metal thin film layer.

17. The plasma display panel of claim 12, with the optical reflective layer being made from an optical reflective film laminated on the second substrate.

18. The plasma display panel of claim 17, with the optical reflective film having a multi-layered structure in which transparent material layers having different refractive indices from each other are alternately stacked.

19. The plasma display panel of claim 12, with the optical reflective layer having a reflectivity of at least 90% for visible light.

* * * * *